US005127994A

United States Patent [19]

Johansson

[11] Patent Number: 5,127,994

[45] Date of Patent: Jul. 7, 1992

[54] PROCESS FOR THE PRODUCTION OF PAPER

[75] Inventor: Hans E. Johansson, Madängsgatan, Sweden

[73] Assignee: Eka Nobel AB, Surte, Sweden

[21] Appl. No.: 300,935

[22] Filed: Jan. 24, 1989

[30] Foreign Application Priority Data

May 25, 1988 [SE] Sweden ..... 8801951

[51] Int. Cl.[5] ..... D21H 3/20; D21H 3/78

[52] U.S. Cl. ..... 162/168.3; 162/175; 162/181.1; 162/181.2; 162/181.3; 162/181.5; 162/181.6; 162/183; 162/185

[58] Field of Search ..... 162/181.6, 181.2, 181.3, 162/181.5, 183, 106, 168.3, 175, 181.4

[56] References Cited

U.S. PATENT DOCUMENTS

| | | | |
|---|---|---|---|
| 4,294,885 | 10/1981 | Sundén | 428/404 |
| 4,388,150 | 6/1983 | Sunden et al. | 162/181.6 X |
| 4,643,801 | 2/1987 | Johnson | 162/164.1 |
| 4,710,270 | 12/1987 | Sundén et al. | 162/175 |
| 4,750,974 | 6/1988 | Johnson | 162/181.6 X |
| 4,927,498 | 5/1990 | Rushmere | 162/168.3 |

FOREIGN PATENT DOCUMENTS

| | | |
|---|---|---|
| 0080986 | 6/1983 | European Pat. Off. . |
| 0041056 | 8/1984 | European Pat. Off. . |
| WO86/00100 | 1/1986 | PCT Int'l Appl. . |
| WO86/05826 | 10/1986 | PCT Int'l Appl. . |
| 2015614 | 9/1979 | United Kingdom . |

*Primary Examiner*—Thi Dang

*Attorney, Agent, or Firm*—Burns, Doane, Swecker & Mathis

[57] ABSTRACT

A process for the production of paper by forming and dewatering a suspension of cellulose containing fibres, and optional fillers, on a wire. The forming and dewatering is carried out in the presence of a combination of an aluminum compound, a cationic retention agent and a polymeric silicic acid having a high specific surface area. The combination of substances improves dewatering and retention of fines and fillers.

25 Claims, No Drawings

PROCESS FOR THE PRODUCTION OF PAPER

The present invention relates to a process for the production of paper utilizing a special combination of substances for improvement of retention and dewatering. More particularly the invention relates to the use of a special combination of an aluminum compound, a polymeric silicic acid and a cationic retention agent.

It is well-known to utilize combinations of cationic retention agents and inorganic silica based colloids in the production of paper for improved retention and drainage. European Patent 41056 discloses the use of cationic starch in combination with silicic acid sols for this purpose and European Patent Application 218674 discloses combinations of cationic polyacrylamides and silica sols. From U.S. Pat. No. 4,643,801 it is further known to utilize a combination of cationic starch, anionic silica sol and an anionic high molecular weight polymer in the production of paper. The three-component system according to this U.S. patent can be used in combination with aluminum compounds such as alum, sodium aluminate and polyaluminum hydroxychloride.

The commercial silica based colloids which have been increasingly used in papermaking during the last few years are of the type which contain colloidal particles with a particle size of from about 4 nm to about 7 nm, i.e. a specific surface area of from about 700 to about 300 $m^2/g$, although it is known, e.g. from European Patent 41056, to use polymeric silicic acid in papermaking. It has generally been considered that colloidal silicic acid sols with particles of the above given size give the best results and these have also been preferred with regard to stability.

According to the present invention it has surprisingly been found that the retention and dewatering effect of a system of a cationic polymeric retention agent and polymeric silicic acid, also called polysilicic acid, with very high specific surface area can be considerably increased by the presence of aluminum compounds. For these systems aluminum compounds provide a substantially improved dewatering effect compared with when they are used in systems with silica based colloids of the commercial type. As a result of the improved dewatering, the speed of the papermachine can be increased and, in addition, less water has to be brought away in the press and drying sections of the papermachine and thus the economics of the papermaking process can be substantially improved. The combinations according to the invention also give an improved strength of the flocks and this in turn means that higher shearing forces can be utilized in the paper production without negative effects. Stocks containing pulp produced according to the sulphate method for the production of different kinds of paper qualities frequently have high contents of salt, and particularly sodium sulphate. This high salt content can give a high ionic strength which can have a negative influence on the effect of the paper chemicals that are used. It has been found that the present systems have a very good tolerance to such high salt contents and that they give a considerably improved effect in such stocks when compared to systems with silica based colloids of the commercial type. The present invention is more effective than commercial silica sols for wood containing stock and stocks of recycled fibres with high contents of dissolved organic substances.

The present invention thus relates to a process for the production of paper by forming and dewatering a suspension of cellulose containing fibres, and optionally fillers, on a wire, whereby the forming and dewatering takes place in the presence of an aluminum compound, a cationic polymeric retention agent and a polymeric silicic acid having a specific surface area of at least 1050 $m^2/g$.

The three components can be added to the fiber suspension in any arbitrary order. The best results are generally obtained if the aluminum compound is added before the two other components. The combination according to the invention can be used for stocks within a broad pH range, from about 4 to about 10. At about neutral pH, 6 to 7, almost equally good results are obtained independent of the order of addition for the cationic retention agent and the polymeric silicic acid. At a more acid pH, i.e., below 6, it is preferred to add the polymeric silicic acid before the cationic retention agent while, as a rule, better effect is obtained if the polymeric silicic acid is added after the cationic retention agent for stocks with a pH above 7.

As the aluminum compound any such compound known for use in paper production can be utilized, for example alum, polyaluminum compounds, aluminates, aluminum chloride and aluminum nitrate. Particularly good results have been obtained with sodium aluminate and thus this compound, which also is cheap, is preferred as the aluminum source.

Alum and sodium aluminate are well-known paper chemicals and thus do not require any further definition. By polyaluminum compounds which are utilized herein it is understood that such compounds are known per se for use in papermaking. Polyaluminum compounds are termed basic and consist of polynuclear complexes. The polyaluminum compounds shall, in aqueous solution, contain at least 4 aluminum atoms per ion and preferably at least 10. The upper amount of aluminum atoms in the complexes are dependent on the composition of the aqueous phase and can vary, e.g. depending on the concentration and the pH. Normally the amount does not exceed 30. The molar ratio of aluminum to counter ion, with the exception of hydroxide ions, should be at least 0.4:1 and preferably at least 0.6:1. An example of a suitable polyaluminum compound include those compounds with the net formula $$n[Al_2(OH)_mCl_{6-m}]$$

which have a basicity of from 30 to 90%, preferably from 33 to 83%. ($m=2$ and $m=5$, respectively). Basicity is defined as the number of OH-groups divided by the number of OH groups and chloride ions $\times 100$, i.e., $(m/6)\times 100$. The polyaluminum compound can also contain anions other than chloride ions, e.g., anions from sulphuric acid, phosphoric acid, and organic acids such as citric acid and oxalic acid. The most common type of polyaluminum compound has $m=3$, i.e. $Al_2(OH)_3Cl_3$, with a basicity of about 50% and compounds of this type, both containing sulphate and such free from sulphate, are commercially available.

Cationic polymeric retention agents which are conventionally used in papermaking can be used in the present invention. In addition, they can be based on carbohydrates or be synthetic. Examples of suitable cationic retention agents include cationic starch, cationic guar gum, cationic polyacrylamides, polyethyleneimines and polyamidoamines. Cationic starch and cationic polyacrylamides are the preferred cationic retention agents.

The polymeric silicic acid which is used as an anionic inorganic substance in the present invention has a very high specific surface area, not less than 1050 $m^2/g$. The particles suitably have a specific surface area within the range of from 1100 to 1700 $m^2/g$ and preferably within the range of from 1200 to 1600 $m^2/g$. The given specific surface area is measured by means of titration according to the method disclosed by Sears in Analytical Chemistry 28(1956)1981. The polymeric silicic acid can be prepared by the acidification of alkali metal silicate, such as potassium or sodium water glass, preferably sodium water glass. These are available with varying molar ratios of $SiO_2$ to $Na_2O$ or $K_2O$ and the molar ratio is usually within the range of from 1.5:1 to 4.5:1 and the water glass usually has an original pH around 13 or above 13. Any such alkali metal silicate or water glass can be used for the preparation of the fine particle polymeric silicic acids and this preparation is carried out by acidification of a diluted aqueous solution of the silicate. Mineral acids, such as sulphuric acid, hydrochloric acid and phosphoric acid, or acid ion exchange resins can, for example be used in the acidification. A number of other chemicals for acidification at production of polysilicic acid are also known and some examples of such other chemicals are ammonium sulphate and carbon dioxide. Mineral acids or acid ion exchange resins or combinations of these are suitably used. The acidification is carried out to a pH within the range of from 1 to 9 and suitably to a pH within the range of from 1.5 to 4. The polymeric silicic acid which is termed activated silicic acid, which is prepared by partial neutralization of the alkali metal content to a pH of about 8 to 9 and polymerication during about half an hour to an hour, can be used as such directly thereafter but must otherwise be diluted to a content of not more than 1 per cent by weight for interrupting the or be acidified to the preferred pH range in order to avoid gelation.

The acidification according to the above is most suitably carried out by means of acid ion exchangers among other things in order to get more stable products and to avoid the addition of the salts from the acidification to the stock through the polymeric silicic acid. The polymeric silicic acid which is formed during the acidification consists of macromolecules or particles of a size of the order of 1 nm which form voluminous chains and networks. Compared with the silica sols of larger particle size which are used commercially in papermaking, those which are utilized in the present invention are considerably less stable both with regard to stability in relation to concentration and stability at storage. After the acidification, the polymeric silicic acids should not be present in concentrations greater than about 5 per cent by weight, and preferably not greater than 2 per cent by weight. They should not be stored for too long times but it has, nonetheless, been found that a certain storage time can be advantageous. Thus, for example, a storage of a day or a couple of days at a concentration of not more than 4 per cent by weight is entirely acceptable with regard to stability and can even result in an improved effect. At a concentration of 1%, or below, storage for two to three weeks without impaired stability is possible and all the time with good effect, or even better effect than without storage. After storage for about three weeks at room temperature, an initial gelation is noticeable. The polymeric silicic acid is principally uncharged at a pH of about 2.0 but anionically charged in the stock with increasing negative charge with increasing stock pH.

The polymeric silicic acids which are used according to the present process should thus be produced in connection with their use and such a production at the location in or close to a paper mill is per se advantageous in that cheap raw materials and simple preparation processes are used. The economy of the present process will thus be very good since the polymeric silicic acid is economically advantageous and the aluminum compounds give a considerable increase in effect.

The amount of polymeric silicic acid and cationic retention agent in paper production according to the present invention can vary within wide limits depending among other things on the type of stock, the presence of fillers and other conditions. The amount of polymeric silicic acid should be at least 0.01 kg/ton, calculated as dry on dry fibers and optional fillers, and is suitably within the range of from 0.1 to 5 kg/ton and preferably within the range of from 0.2 to 2 kg/ton. The polymeric silicic acid is suitably added to the stock in the form of aqueous solutions having dry contents within the range of from 0.1 to 1 per cent by weight. The amount of cationic retention agent to polymeric silicic acid is highly dependent on the type of cationic retention agent and other effects desired from this. The weight ratio of cationic retention agent to polymeric silicic acid should usually be at least 0.01:1 and suitably at least 0.2:1. The upper limit for the cationic retention agent is first of all a question of economy and of charge. For retention agents with lower cationicity, such as cationic starch, very high amounts can thus be used, up to a ratio of 100:1 and higher, and the limit is mainly set by reasons of economy. For most systems, suitable ratios of cationic retention agent to polymeric silicic acid are within the range of from 0.2:1 to 20:1. The amount of aluminum compound can also vary within wide limits and it is suitable to use the aluminum compound in a weight ratio to the polymeric silicic acid of at least 0.01:1, whereby the aluminum compound has been calculated as $Al_2O_3$. Suitably the ratio does not exceed 3:1 and is preferably within the range of from 0.02:1 to 1.5.1 and most preferably within the range of from 0.05:1 to 0.7:1.

The present three-component system can be used in the production of paper from different types of stocks of cellulose containing fibers and the stocks should contain at least 50 per cent by weight of such fibers. The components can, for example, be used as additives to stocks from fibers from chemical pulp, such as sulphate and sulphite pulp, thermomechanical pulp, refiner mechanical pulp or groundwood pulp, from as well hardwood as softwood and can also be used for stocks based on recycled fibers. The stocks can also contain mineral fillers of conventional types such as kaolin, titanium dioxide, gypsum, chalk and talcum. Particularly good results have been obtained with stocks which are usually considered as difficult and which contain comparatively high amounts of non-cellulose substances such as lignin and dissolved organic materials, for example different types of mechanical pulps such as groundwood pulp. The combinations according to the invention are particularly suitable for stocks containing at least 25 per cent by weight of mechanical pulp. It should also be mentioned that the combination according to the invention has shown superior properties for stocks which have a high ionic strength due to the presence of salts, such as sodium sulphate, which often occur as residual chemicals from the original pulp production, the bleaching or from recycled fibres. The terms paper and paper production which are used herein do of course include, in addition to paper, board and paper, board prepared from stocks containing mainly cellulose containing fibres.

In the present process for the production of paper, other conventional paper additives can of course be used in addition to the three components according to the invention. Fillers have been discussed above and as examples of other additives can be mentioned hydrophobing agents, based on rosin or synthetic hydrophobing agents, wet strength resins, etc.

The invention is further illustrated in the following examples which, however, are not intended to limit the same. Parts and per cent relate to parts by weight and per cent by weight respectively, unless otherwise stated.

EXAMPLE 1

A polymeric silicic acid was prepared according to the following. Water glass ($Na_2O.3SiO_2$) was diluted with water to a $SiO_2$ content of 5 per cent by weight. The aqueous solution was ion exchanged using ion exchange resin Amberlite IR-120 to a pH of 2.3. The specific surface area of the obtained acid polymeric silicic acid was measured by titration according to the mentioned method and found to be 1450 $m^2/g$.

EXAMPLE 2

In this test the dewatering was evaluated with a "Canadian Freeness Tester" which is the conventional method for characterizing drainage according to SCAN-C 21:65. All additions of chemicals were made in a "Britt Dynamic Drainage Jar" with a blocked outlet at a stirring speed of 800 rpm during 45 seconds and the stock system was then transferred to the Canadian Freeness apparatus.

The stock was a groundwood pulp beaten to 120 ml CSF. The aluminum compound used was sodium aluminate and the cationic retention agent was cationic starch. The polymeric silicic acid according to Example 1 was used and comparisons were made with a commercial silica sol produced by Eka Nobel AB and having a specific surface area of 500 $m^2/g$. The cationic starch (CS) was in all tests added in an amount corresponding to 10 kg/ton dry pulp. The polymeric silicic acid (=the polysilicic acid) and the commercial sol for comparison were added in an amount corresponding to 1 kg, calculated as $SiO_2$, per ton dry pulp and the amount of aluminate, calculated as $Al_2O_3$, was 0.15 kg/t when it was added. The tests were carried out at a pH of 8.5 and with varying additions, g/l stock, of salt, $Na_2SO_4.10H_2O$. The aluminate was added first in all tests, the cationic retention agent was added subsequently and lastly the polysilicic acid or the commercial sol was added.

| Salt g/l | $Al_2O_3$ kg/t | CS kg/t | Polysilicic acid kg/t | Commercial sol kg/t | CSF ml |
|---|---|---|---|---|---|
| — | — | 10 | 1 | — | 315 |
| — | 0.15 | 10 | 1 | — | 430 |
| — | — | 10 | — | 1 | 280 |
| — | 0.15 | 10 | — | 1 | 365 |
| 0.5 | — | 10 | 1 | — | 300 |
| 0.5 | 0.15 | 10 | 1 | — | 410 |
| 0.5 | — | 10 | — | 1 | 265 |
| 0.5 | 0.15 | 10 | — | 1 | 310 |
| 2.0 | — | 10 | 1 | — | 280 |
| 2.0 | 0.15 | 10 | 1 | — | 375 |
| 2.0 | — | 10 | — | 1 | 240 |

-continued

| Salt g/l | $Al_2O_3$ kg/t | CS kg/t | Polysilicic acid kg/t | Commercial sol kg/t | CSF ml |
|---|---|---|---|---|---|
| 2.0 | 0.15 | 10 | — | 1 | 295 |

EXAMPLE 3

With the same stock, groundwood pulp beaten to 120 ml CSF, and the same procedure as in Example 2 tests were carried out at different pH of the stock and using different cationic retention agents, cationic guar gum, (guar), cationic polyacrylamide (PAM) sold by Allied Colloids under the designation Percol 140, and polyethyleneimine (PEI) sold by BASF under the designation Polymin SK. 0.5 g/l of $Na_2SO_4.10H_2O$ had been added to the stock. Sodium aluminate was used as the aluminum compound. The retention agent was in all tests added to the pulp before addition of the polymeric silicic acid according to the Example 1.

| pH | $Al_2O_3$ kg/t | Ret. agent type/kg/t | Polysilicic acid kg/t | CSF ml |
|---|---|---|---|---|
| 7.5 | — | guar/3.3 | 1 | 300 |
| 7.5 | 0.15 | guar/3.3 | 1 | 375 |
| 5.5 | — | PEI/0.67 | 1 | 205 |
| 5.5 | 0.60 | PEI/0.67 | 1 | 270 |
| 7.0 | — | PAM/0.67 | 1 | 220 |
| 7.0 | 0.15 | PAM/0.67 | 1 | 275 |

EXAMPLE 4

In this example a standard pulp of 60% bleached birch sulphate pulp and 40% bleached pine sulphate pulp with 30% added chalk and 0.5 g/l of added $Na_2SO_4.10H_2O$ was used. The pH of the stock was 8.5 and the freeness tests were carried out as in Example 2. The order of addition was as follows: aluminum compound, cationic starch (CS) and then polysilicic acid or commercial sol according to Example 2 for comparison. In addition to aluminate tests were also made with alum, aluminum chloride ($AlCl_3$) and polyaluminum chloride (PAC). The last mentioned compound was the polyaluminum chloride sold by Hoechst AG under the designation Povimal. The amounts for all the aluminum compounds are given as $Al_2O_3$. The original CSF for the stock was 295.

| Al-compound type/kg/t | CS kg/t | Polysilicic acid kg/t | Commercial sol kg/t | CSF ml |
|---|---|---|---|---|
| — | 10 | 1 | — | 570 |
| aluminate/0.15 | 10 | 1 | — | 710 |
| alum/0.15 | 10 | 1 | — | 695 |
| $AlCl_3$/0.15 | 10 | 1 | — | 690 |
| PAC/0.15 | 10 | 1 | — | 690 |
| Comparison: | | | | |
| — | 10 | — | 1 | 505 |
| aluminate/0.15 | 10 | — | 1 | 570 |

The polysilicic acid, according to Example 1, which was used in this Example had been stored as a 0.15% solution for 8 hours. When the test was made with the polysilicic acid according to Example 1 directly after its preparation, in an amount of 1 kg/t using 0.15 kg/t of aluminate, calculated as $Al_2O_3$, and 10 kg of cationic starch, the CSF was 625 ml. When the tests were repeated with the same polysilicic acid stored for 25 and 75 hours respectively the same good results as shown in the Table above were obtained, and in some cases even somewhat better results, and likewise so when the polysilicic acid had first been stored as a 1% solution for 2 days and then as a 0.15% solution or as a 1% solution for 1 day.

EXAMPLE 5

In this example the retention of fillers and fine fibers was measured. The stock was made up from 25% chemical pulp and 75% groundwood pulp and contained 30% chalk. 0.5 g/l of $Na_2SO_4.10H_2O$ had been added to the stock which had a concentration of 5.1 g/l and a pH of 8.5. The content of fines in the stock was 48.1%. The retention measurements were made with a "Britt Dynamic Jar" at a rpm of 1000. Aluminate was used as aluminum compound in an amount of 0.15 kg/t calculated as $Al_2O_3$. The cationic retention agent was cationic starch and it was added in an amount of 10 kg/t and the polysilicic acid was added in an amount of 1 kg/t. All amounts are on dry stock system (fibers and fillers). Some different polysilic acids were used: A) a polysilicic acid according to Example 1 which was used directly after its preparation. B) a polysilicic acid prepared according to the following: A water glass ($Na_2O.3.3SiO_2$) solution, 1% with regard to $SiO_2$, was ion exchanged to pH 2.3 and stored for one week. The polysilicic acid had a specific surface area of about 1600 $m^2/g$. C) a polysilicic acid prepared according to the following: 2.61 g of 97% $H_2SO_4$ were diluted to 250 g. 190.5 g of 5.25% $Na_2O.3.3SiO_2$ were diluted to 500.4 g. 280.5 g of the last solution were added to the diluted sulphuric acid solution and 530.5 g of polysilicic acid was hereby obtained and this was diluted with 30.5 g of water and the resulting polysilic acid then had a $SiO_2$ content of 1% and a pH of 2.4. The specific surface area was measured to about 1500 $m^2/g$. D) a polysilicic acid, activated silica, prepared according to the following: 776.70 g of 5.15% water glass ($Na_2O.3.3SiO_2$) were diluted to 1000 g. 15.40 g of 96% sulphuric acid were diluted to 1000 g. The two solutions were mixed and hereby activated silica with an $SiO_2$ content of 2.0% and a pH of about 8.75 was obtained. This solution was allowed to stand for about 1 hour and was then acidified with additional $H_2SO_4$ to a pH of about 2.5 and diluted with water to an $SiO_2$ content of 1.0%. The specific surface area was measured to 1540 $m^2/g$.

| $Al_2O_3$ kg/t | Polysilicic acid | Retention % |
|---|---|---|
| — | A | 71.1 |
| 0.15 | A | 85.0 |
| — | B | 68.0 |
| 0.15 | B | 88.0 |
| — | C | 40.4 |
| 0.15 | C | 69.0 |
| — | D | 65.0 |
| 0.15 | D | 74.0 |

EXAMPLE 6

In this example a stock of groundwood pulp with addition of 0.5 g/l of $Na_2SO_4.10H_2O$ was used. The pulp had been beaten to 120 ml CSF and its pH had been adjusted to 4.5 with $H_2SO_4$. Sodium aluminate was used as aluminum compound and added in varying amounts to the given pH. After addition of aluminate polysilicic acid according to Example 1 and commercial silica sol according to Example 2 were added and cationic starch (CS) was added lastly. The drainage results in the tests are given in ml CSF.

| pH | $Al_2O_3$ kg/t | Polysilicic acid, kg/t | Comm. sol kg/t | CS kg/t | CSF ml |
|---|---|---|---|---|---|
| 4.9 | 0.15 | 1 | — | 10 | 270 |
| 5.2 | 0.30 | 1 | — | 10 | 300 |
| 5.5 | 0.60 | 1 | — | 10 | 380 |
| 4.9 | 0.15 | — | 1 | 10 | 200 |
| 5.5 | 0.60 | — | 1 | 10 | 260 |

EXAMPLE 7

In this example the same stock and dosage order as in Example 4 was used and the effect of varying amounts of polysilicic acid and commercial sol, respectively, according to Example 2 was investigated. Sodium aluminate was used as aluminum compound in all tests and the cationic retention agent was cationic starch (CS). The effect on dewatering was evaluated as described earlier.

| $Al_2O_3$ kg/t | CS kg/t | Polysilicic acid, kg/t | Comm. sol, kg/t | CSF ml |
|---|---|---|---|---|
| — | 10 | — | 0.5 | 420 |
| — | 10 | — | 1 | 505 |
| — | 10 | — | 2 | 550 |
| 0.075 | 10 | — | 0.5 | 450 |
| 0.15 | 10 | — | 1 | 570 |
| 0.3 | 10 | — | 2 | 590 |
| — | 10 | 0.5 | — | 520 |
| — | 10 | 1 | — | 570 |
| — | 10 | 2 | — | 590 |
| 0.075 | 10 | 0.5 | — | 615 |
| 0.15 | 10 | 1 | — | 710 |
| 0.3 | 10 | 2 | — | 700 |

EXAMPLE 8

In this example the dewatering effect with different polysilicic acids in combination with sodium aluminate and cationic retention agent, cationic starch (CS) and cationic polyacrylamide (PAM), was investigated. The stock was a groundwood pulp stock with a pH of 7.5 and contained 0.5 g/l of $Na_2SO_4.10H_2O$. The chemicals were added to the stock in the following order: aluminum compound, cationic retention agent and finally polysilicic acid. CSF was measured as described earlier. The polysilicic acids used in the tests were B) according to Example 5, C) according to Example 5, D) according to Example 5, E) a polysilicic acid according to B) for which pH had been adjusted to 8.5 with NaOH and which had then after 10 minutes been diluted to a concentration of 0.15%, F) a polysilicic acid, activated silica, prepared by addition of sulphuric acid to water glass to a solution containing 2% $SiO_2$ and having a pH of 8.7. The solution was diluted to 1% $SiO_2$ and then used directly, G) a polysilicic acid according to F) which had been stored for one hour at a pH of 8.7 and a concentration of 2% and then been diluted to 1% before use.

| $Al_2O_3$ kg/t | Cationic retention agent type; kg/t | Polysilicic acid, type; kg/t | CSF ml |
|---|---|---|---|
| — | CS; 10 | B; 1 | 310 |
| 0.15 | CS; 10 | B; 1 | 520 |
| — | CS; 10 | C; 1 | 290 |
| 0.15 | CS; 10 | C; 1 | 460 |
| — | CS; 10 | D; 1 | 280 |

-continued

| $Al_2O_3$ kg/t | Cationic retention agent type; kg/t | Polysilicic acid, type; kg/t | CSF ml |
|---|---|---|---|
| 0.15 | CS; 10 | D; 1 | 435 |
| — | CS; 10 | E; 1 | 300 |
| 0.15 | CS; 10 | E; 1 | 485 |
| — | CS; 10 | F; 1 | 295 |
| 0.15 | CS; 10 | F; 1 | 470 |
| — | CS; 10 | G; 1 | 310 |
| 0.15 | CS; 10 | G; 1 | 510 |
| — | PAM; 0.67 | B; 1 | 390 |
| 0.15 | PAM; 0.67 | B; 1 | 475 |
| — | PAM; 0.67 | C; 1 | 345 |
| 0.15 | PAM; 0.67 | C; 1 | 430 |
| — | PAM; 0.67 | D; 1 | 385 |
| 0.15 | PAM; 0.67 | D; 1 | 465 |
| — | PAM; 0.67 | E; 1 | 370 |
| 0.15 | PAM; 0.67 | E; 1 | 450 |
| — | PAM; 0.67 | F; 1 | 360 |
| 0.15 | PAM; 0.67 | F; 1 | 435 |
| — | PAM; 0.67 | G; 1 | 365 |
| 0.15 | PAM; 0.67 | G; 1 | 460 |

I claim:

1. A process for the production of paper comprising forming and dewatering a suspension of cellulose containing fibers on a wire, wherein the forming and dewatering takes place in the presence of three components comprising an aluminum compound, a cationic polymeric retention agent and a polymeric silicic acid having a specific surface area of at least 1050 $m^2/g$, said components being separately added to the stock prior to the forming and dewatering and wherein said aluminum compound is selected from the group consisting of alum, aluminates, aluminum chloride, aluminum nitrate, polyaluminum chlorides, polyaluminum sulfates, polyaluminum chlorides containing sulfate, and mixtures thereof, and further wherein said aluminum compound, calculated as $Al_2O_3$, being added in a weight ratio to polymeric silicic acid of at least 0.01:1.

2. The process according to claim 1, wherein the suspension contains fillers.

3. A process according to claim 2, wherein the polymeric silicic acid has a specific surface area within the range of from 1100 to 1700 $m^2/g$.

4. The process according to claim 3, wherein the polymeric silicic acid has been prepared by acidification of an alkaline metal water glass to a pH within the range of from 1.5 to 4.

5. The process according to claim 4, wherein the polymeric silicic acid is added in the amount of at least about 0.01 kg/t, based on dry fibers and fillers.

6. The process according to claim 3, wherein the polymeric silicic acid is added in the amount of at least about 0.01 kg/t, based on dry fibers and fillers.

7. A process according to claim 2, wherein the polymeric silicic acid has been prepared by acidification of an alkali metal water glass to a pH within the range of from 1.5 to 4.

8. A process according to claim 7, wherein the polymeric silicic acid has been prepared by acidification by means of an acid cation exchanger.

9. The process according to claim 7, wherein the polymeric silicic acid is added in the amount of at least about 0.01 kg/t, based on dry fibers and fillers.

10. A process according to claim 2, wherein the aluminum compound is added to the suspension before the cationic polymeric retention agent and the polymeric silicic acid.

11. The process according to claim 10, wherein the aluminum compound comprises sodium aluminate.

12. A process according to claim 2, wherein the cationic retention agent comprises cationic starch or cationic polyacrylamide.

13. The process according to claim 12, wherein the cationic retention agent is added in a weight ratio to the polymeric silicic acid of at least 0.01:1.

14. A process according to claim 2 wherein the polymeric silicic acid is added in an amount of at least 0.01 kg/t, based on dry fibers.

15. A process according to claim 2, wherein the aluminum compound comprises sodium aluminate.

16. A process according to claim 2, wherein the cationic polymeric retention agent is added in a weight ratio to the polymeric silicic acid of at least 0.01:1.

17. A process according to claim 1, wherein the polymeric silicic acid has been prepared by acidification of an alkalic metal water glass to a pH within the range of from 1.5 to 4.

18. A process according to claim 17, wherein the polymeric silicic acid has been prepared by acidification by means of an acid cation exchanger.

19. A process according to claim 1, wherein the aluminum compound is added to the suspension before the cationic polymeric retention agent and the polymeric silicic acid.

20. A process according to claim 1, wherein the polymeric silicic acid has a specific surface area within the range of from 1100 to 1700 $m^2/g$.

21. A process according to claim 1, wherein the polymeric silicic acid is added in an amount of at least 0.01 kg/t, based on dry fibers.

22. A process according to claim 1, wherein the aluminum compound comprises sodium aluminate.

23. A process according to claim 1, wherein the cationic retention agent comprises cationic starch or cationic polyacrylamide.

24. A process according to claim 1, wherein the cationic retention agent is added in a weight ratio to the polymeric silicic acid of at least 0.01:1.

25. A process according to claim 1 wherein the aluminum compound is selected from the group consisting of alum, aluminates, polyaluminum chlorides, polyaluminum chlorides containing sulfate, and mixtures thereof.

* * * * *